US010180658B2

(12) United States Patent
Tomiyasu

(10) Patent No.: US 10,180,658 B2
(45) Date of Patent: Jan. 15, 2019

(54) IMAGE FORMING APPARATUS

(71) Applicant: CANON KABUSHIKI KAISHA, Tokyo (JP)

(72) Inventor: Hiroaki Tomiyasu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/833,280

(22) Filed: Dec. 6, 2017

(65) Prior Publication Data

US 2018/0157211 A1 Jun. 7, 2018

(30) Foreign Application Priority Data

Dec. 7, 2016 (JP) ..... 2016-237687

(51) Int. Cl.

| | |
|---|---|
| ***G03G 15/00*** | (2006.01) |
| ***G03G 21/20*** | (2006.01) |
| ***G03G 15/02*** | (2006.01) |
| ***G03G 21/00*** | (2006.01) |

(52) U.S. Cl.

CPC ..... *G03G 21/206* (2013.01); *G03G 15/0266* (2013.01); *G03G 21/0005* (2013.01)

(58) Field of Classification Search

CPC ..... G03G 21/206; G03G 15/0266
USPC ..... 399/44
See application file for complete search history.

(56) References Cited

U.S. PATENT DOCUMENTS 5,077,566 A * 12/1991 Ochiai ..... G03G 21/0035 399/44
6,510,294 B1 * 1/2003 Hakamada ..... G03G 15/0848 399/44
2014/0105621 A1 * 4/2014 Imanaka ..... G03G 15/0266 399/44

FOREIGN PATENT DOCUMENTS

JP 09062161 A * 3/1997

* cited by examiner

*Primary Examiner* — Susan S Lee
(74) *Attorney, Agent, or Firm* — Canon U.S.A., Inc. IP Division

(57) ABSTRACT

An image forming apparatus includes a photoconductor, a developing unit, a transfer unit, a detecting unit, a fan, cleaning unit, and a controller. The developing unit develops a latent image with a developer. The transfer unit transfers a developer image onto a sheet. The detecting unit detects a temperature outside the apparatus. The fan takes outside air into the apparatus. The cleaning unit collects toner supplied onto the photoconductor. The controller determines whether dew condensation has occurred. If the controller determines that dew condensation has occurred, the controller executes a first dew condensation recovery operation for rotating the fan, and when an image forming job is input, the controller executes a second dew condensation recovery operation, in addition to the first dew condensation recovery operation, the second dew condensation recovery operation comprising supplying toner to the photoconductor and collecting the toner, before executing the image forming job.

11 Claims, 10 Drawing Sheets

IMAGE FORMING APPARATUS

BACKGROUND

Field

The present disclosure relates to electrophotographic image forming apparatuses.

Description of the Related Art

Dew condensation can occur in image forming apparatuses because of a change in the environment of the installation office. Assume that an image forming apparatus is installed in an office under a cold condition. When the ambient temperature is increased by operation of an air heater, the temperature inside the image forming apparatus can follow the change in the external temperature with a delay of several tens of minutes to several hours. During that time, a large temperature difference can occur between the inside and the outside of the image forming apparatus. When a job is submitted in the case where the temperature difference between the inside and the outside of the image forming apparatus is large, various IC chips, such as a motor driver, operate, and an air-cooling fan rotates to suppress a temperature rise. At that time, outside air is taken into the apparatus by the air-cooling fan.

The air taken into the apparatus by the rotation of the air-cooling fan can cause dew condensation on an exposure unit, a photoconductor, and a transfer unit, because of a temperature difference between the inside of the image forming apparatus and the outside of the image forming apparatus. The dew condensation can cause missing and blurriness of images and other phenomena. Furthermore, the dew condensation on the photoconductor can cause fluctuations in a frictional force against a cleaning blade to cause noise or abnormal noise.

U.S. Patent Application Publication No. 2014/0105621 proposes to determine the condition of dew condensation from temperature fluctuations before and after fan rotation using a temperature sensor. According to U.S. Patent Application Publication No. 2014/0105621, the dew condensation on the photoconductor is eliminated by eliminating the temperature difference between the inside and the outside of the apparatus by the operation of the fan or by applying toner onto the photoconductor.

U.S. Patent Application Publication No. 2014/0105621 discloses the following two methods for recovering from dew condensation when it is determined that dew condensation has occurred in the apparatus. A first method is a method of recovering from the dew condensation by eliminating the temperature difference between the inside and the outside of the apparatus by fan operation. A second method is a method of recovering from the dew condensation by supplying toner from a developing unit onto a photoconductor, absorbing moisture on the surface of the photoconductor with the toner, and collecting the toner with a cleaner. The first method takes some time to recover from the dew condensation. In contrast, the second method can recover from the dew condensation faster than the first method but wastefully consumes toner.

There may be cases where even if dew condensation has occurred in the apparatus, a dew condensation recovery operation using the second method is not needed because no image forming job can be submitted for a while. In such cases, when the dew condensation recovery operation using the second method is executed, the toner is wastefully consumed.

SUMMARY

Various embodiments of the present disclosure prevent toner from being consumed in a dew condensation recovery operation when no job is input. According to one embodiment of the present disclosure, an image forming apparatus includes a photoconductor, a developing unit, a transfer unit, a detecting unit, a rotatable fan, a cleaning unit, and a controller. The developing unit is configured to develop a latent image formed on the photoconductor, with a developer. The transfer unit is configured to transfer a developer image developed on the photoconductor onto a sheet. The detecting unit is configured to detect a temperature outside the image forming apparatus. The cleaning unit is configured to collect toner supplied onto the photoconductor. The controller is configured to determine whether dew condensation has occurred based on information detected by the detecting unit. In a case where the controller determines that dew condensation has occurred, the controller executes a first dew condensation recovery operation for rotating the fan, and when an image forming job is input, the controller executes a second dew condensation recovery operation, in addition to the first dew condensation recovery operation, the second dew condensation recovery operation comprising supplying toner from the developing unit to the photoconductor and collecting the toner with the cleaning unit, before executing the image forming job.

Further features of the present disclosure will become apparent from the following description of exemplary embodiments with reference to the attached drawings.

DESCRIPTION OF THE EMBODIMENTS

Various embodiments of the present disclosure will be described hereinbelow with reference to the drawings. It is to be understood that the following embodiments are not intended to limit the claims and that not all of combinations of the features described in the described embodiments are absolutely necessary for embodiments of the present disclosure.

Figure 1:
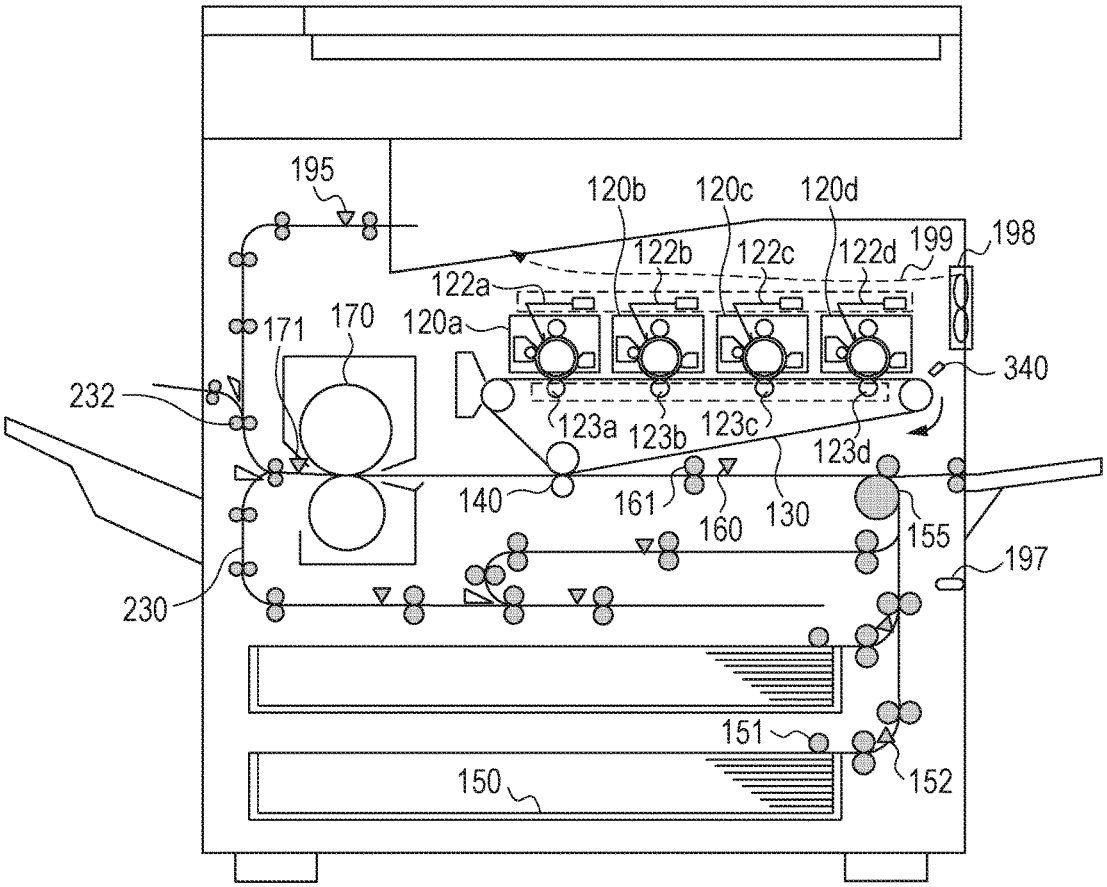
FIG. 1 is a longitudinal sectional view of an image forming apparatus according to an embodiment of the present disclosure.
Figure 2:
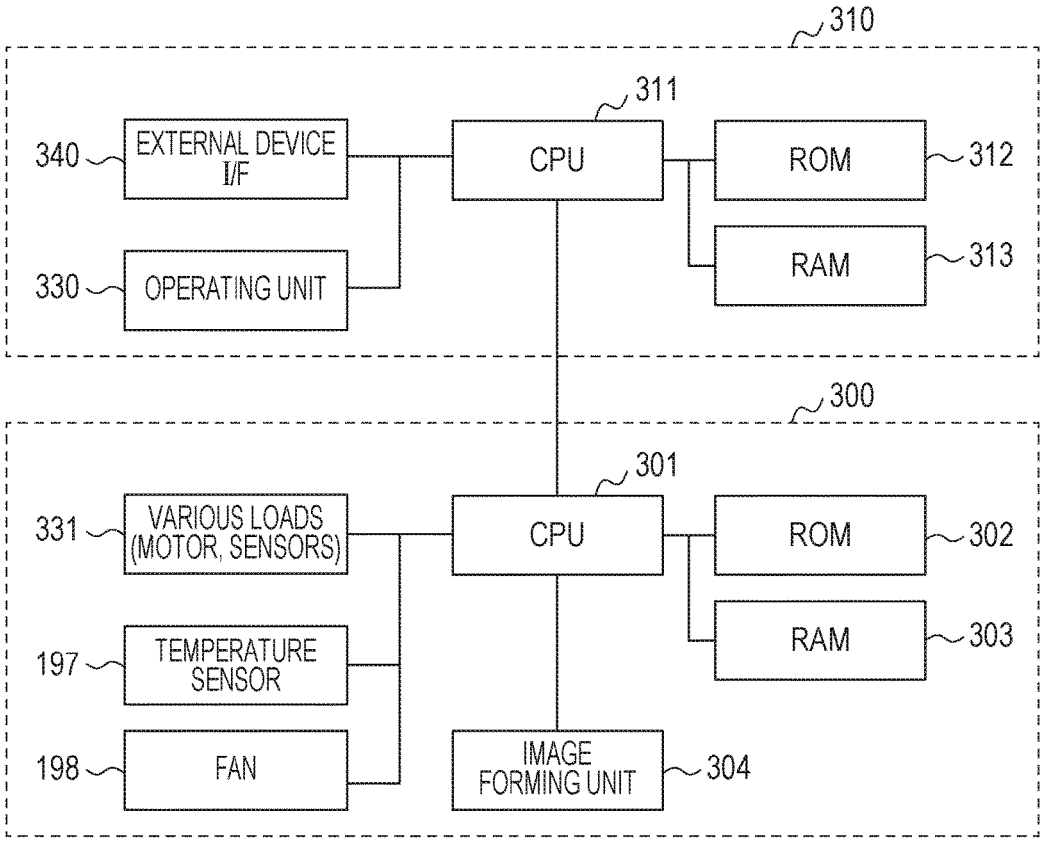
FIG. 2 is a block diagram illustrating a hardware configuration according to an embodiment of the present disclosure.

FIG. 1 is a longitudinal sectional view of an image forming apparatus according to the present embodiment. FIG. 2 is a block diagram illustrating an example of the hardware configuration of the present embodiment. The basic configuration will be described with reference to FIGS. 1 and 2.

Referring to FIG. 2, the configuration is roughly divided into a block 310 and a block 300. The reason for dividing the configuration into blocks in this way is to disperse control loads relating to image formation. When the image forming apparatus has shifted to a power saving mode, the power on the block 300 side is saved by supplying power only to the block 310.

The block 310 is controlled by a CPU 311, and the block 300 is controlled by a CPU 301. The block 310 is mainly constituted of devices that process external input. The block 300 mainly controls a motor and other devices.

The CPU 311 controls the devices in the block 310. The CPU 311 loads programs stored in a ROM 312 onto a RAM 313 to execute the process in a flowchart described below. The CPU 311 controls various devices on the basis of an instruction for an image forming job from an operating unit 330 or an instruction for an image forming job received from an external device, such as a personal computer (PC), via an external device I/F 340. The CPU 311 communicates with the CPU 301 in the block 300 to start the operation of various loads 331 in the block 300.

The CPU 301 controls various devices in the block 300. The CPU 301 loads programs stored in a ROM 302 to execute the process in a flowchart described below. Upon receiving an operation request from the CPU 311, the CPU 301 controls the driving of the plurality of loads 331, such as a motor. The CPU 301 can also detect input signals from a preregistration conveyance sensor 160, sheet conveyance sensors 171 and 195, a fan 198, and a temperature sensor 197, or a temperature detection unit.

The fan 195 is a rotatable blower for taking outside air into the apparatus. When the fan 195 rotates, outside air flows into the image forming apparatus. The fan 198 starts rotating with the start of the image forming job and finishes the rotation at the end of the image forming job. When the fan 198 rotates, outside air is taken in and passes through an airflow channel 199 into a slit provided at an output tray. The airflow channel 199 is used to reduce or eliminate the temperature rise of cartridges 120*a* to 120*d* to reduce image fluctuations due to expansion of the photoconductors in the cartridges 120*a* to 120*d*.

The CPU 301 also controls an image forming unit 304. The image forming unit 304 includes the cartridges 120*a* to 120*d*, an intermediate transfer belt 130, primary transfer units 123*a* to 123*d*, a secondary transfer unit 140, and laser scanners 122*a* to 122*d*, illustrated in FIG. 1.

Referring to FIGS. 1 and 2, a basic image forming operation will be described. Upon receiving an instruction to start an image forming job via the external device I/F 340 or the like, the CPU 311 instructs the CPU 301 to start a printing operation. The CPU 301 starts an operation of feeding paper (sheet) from a sheet cassette 150. The CPU 301 causes a pre-fixation conveying motor serving as a driving source to operate so that a sheet pickup roller 151 rotates, and the sheets in the sheet cassette 150 are conveyed one by one. At that time, the CPU 301 determines whether the sheet feeding operation has been normally performed on the basis of detection information from a sheet pickup sensor 152.

The CPU 301 starts an image forming operation using the cartridges 120*a*, 120*b*, 120*c*, and 120*d* so as to be in time for a timing at which the sheet reaches the secondary transfer unit 140. The cartridge 120*a* is a cartridge for forming a yellow image, the cartridge 120*b* is a cartridge for forming a magenta image, the cartridge 120*c* is a cartridge for forming a cyan image, and the cartridge 120*d* is a cartridge for forming a black image. The image forming apparatus of the present embodiment is configured so that the user can mount and remove the cartridges 120*a* to 120*d*.

Figure 3:
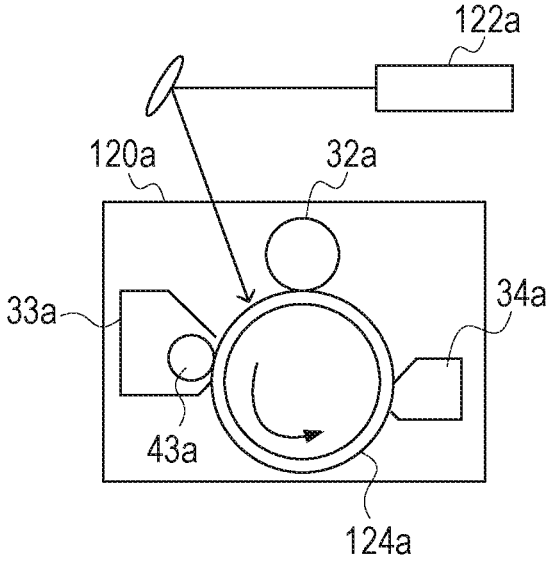
FIG. 3 is a diagram illustrating the configuration of an image forming unit according to an embodiment of the present disclosure.

FIG. 3 is a diagram illustrating the configuration of the cartridge 120. Although FIG. 3 illustrates the configuration of the yellow cartridge 120*a*, the magenta, cyan, and black cartridges 120*b* to 120*d* have the same configuration. A photoconductor 124*a* is an example of an image bearing member.

After the surface of the photoconductor 124*a*, or an image bearing member, is charged by a charging roller 32*a*, a latent image is formed on the photoconductor 124*a* by a laser light emitted from a laser scanner 122*a*. The formed latent image is developed on the photoconductor 124*a* with a toner in a developing unit 33*a* via a developing roller 43*a*. Thereafter, the toner image (developer image) developed on the photoconductor 124*a* is supplied with a primary transfer voltage at the primary transfer units 123*a* to 123*d* in FIG. 1 and is transferred to the intermediate transfer belt 130. The toner image transferred to the intermediate transfer belt 130 is brought to the secondary transfer unit 140 by the rotation of the intermediate transfer belt 130.

Referring back to FIG. 1, the CPU 301 detects the position of the sheet conveyed by a conveying roller 155 on the basis of detected information from the preregistration conveyance sensor 160. The CPU 301 controls the conveyance of the sheet in consideration of the timing at which the end of the sheet reaches the preregistration conveyance sensor 160 so that the leading end of the sheet and the leading end of the toner image on the intermediate transfer belt 130 match at the secondary transfer unit 140. For example, in the case where the sheet has reached faster than the toner image, the sheet is stopped at a preregistration conveying roller 161 for a predetermined time and is thereafter conveyed again. By applying a secondary transfer voltage to the sheet and the toner image that have reached the secondary transfer unit 140 as in the above, the toner image is transferred to the sheet.

The sheet after the secondary transfer is conveyed to a fixing unit 170. The fixing unit 170 fixes the toner image on the sheet onto the sheet by heating. Thereafter, the sheet is further conveyed downstream of the apparatus. When the leading end of the sheet after the fixation reaches the sheet conveyance sensor 171, in the case of a double-sided printing mode, the sheet is conveyed to a sheet conveying path 230. In the case of a one-sided printing mode or back surface printing at the double-sided printing mode, a conveying flapper is switched to convey the sheet to a sheet conveying path 232. The sheet conveyed to the sheet conveying path 232 is further conveyed downstream and drops onto an output tray under its own weight and is stacked on the output tray.

Dew Condensation Occurrence Conditions

Figure 4:
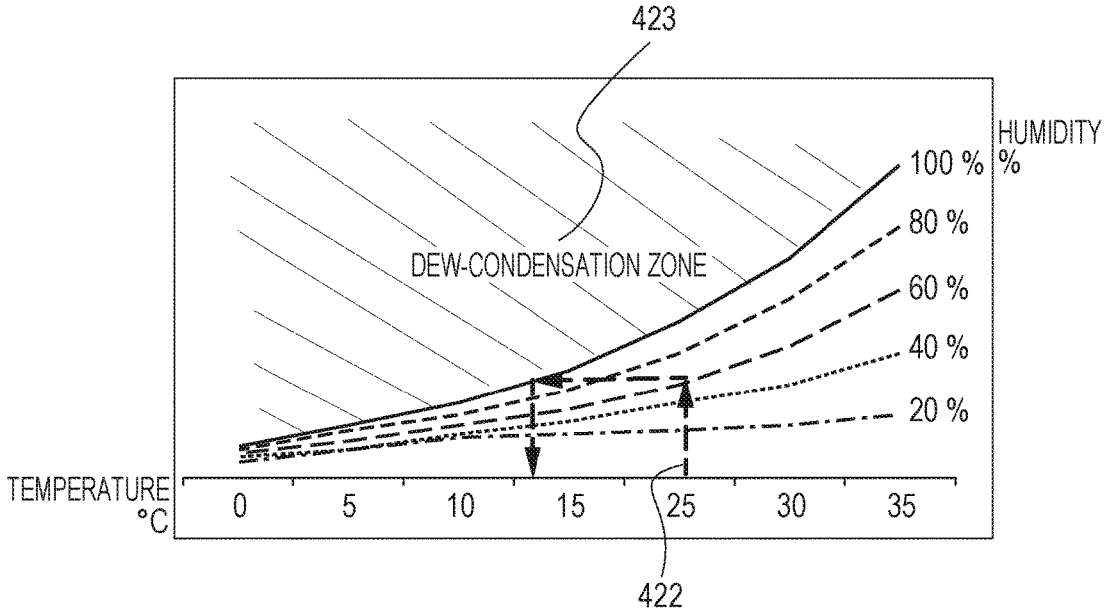
FIG. 4 is a graph illustrating dew-point temperatures.

Referring to FIG. 4, dew condensation occurrence conditions will be described. FIG. 4 illustrates dew-point temperatures calculated from external environment humidity and external environment temperature. For example, in an office environment 422 at a temperature of 25° C. and a humidity of 60%, the humidity reaches 100% into a dew condensation zone 423 when the temperature decreases to 13° C. In other words, a condition under which dew condensation occurs in an image forming apparatus in an office environment of a temperature of 25° C. and a humidity of 60% is when the interior of the image forming apparatus is at 13° C. Therefore, the dew-point temperature is 13° C.

Such a temperature difference (between the external temperature 25° C. and the in-apparatus temperature 13° C.) occurs when the external environment temperature rises rapidly due to an air heating operation, while the interior of the image forming apparatus remains cold.

Figure 5:
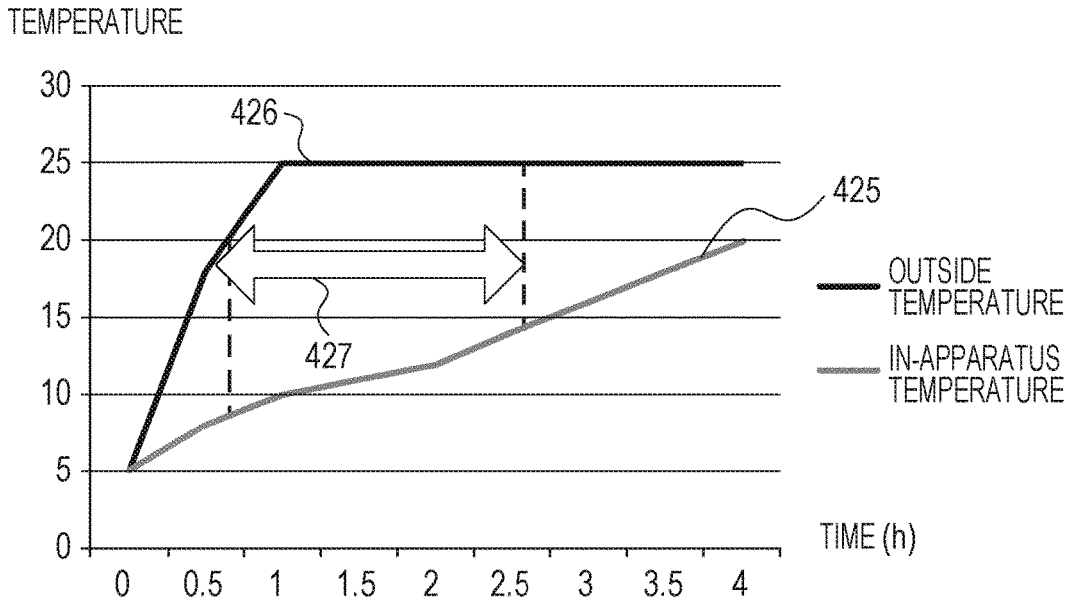
FIG. 5 is a graph illustrating the temperature difference between outside and inside of an image forming apparatus.

FIG. 5 is a graph illustrating the temperature difference between the outside and the inside of the image forming apparatus. An external temperature 426 increases from 5° C. to 25° C. in one hour, whereas a temperature 425 inside the image forming apparatus experiences that same increase in temperature over about four hours. This causes a zone 427 in which there is a temperature difference of about 13° C. between the image forming apparatus and the external environment, as illustrated in FIG. 5. When an image forming lob is submitted in this zone, so that the air-cooling fan 198 rotates to cause outside air to flow into the image forming apparatus, the warm temperature air is cooled, so that the dew point drops, causing dew condensation.

First Dew Condensation Recovery Operation

Figure 6:
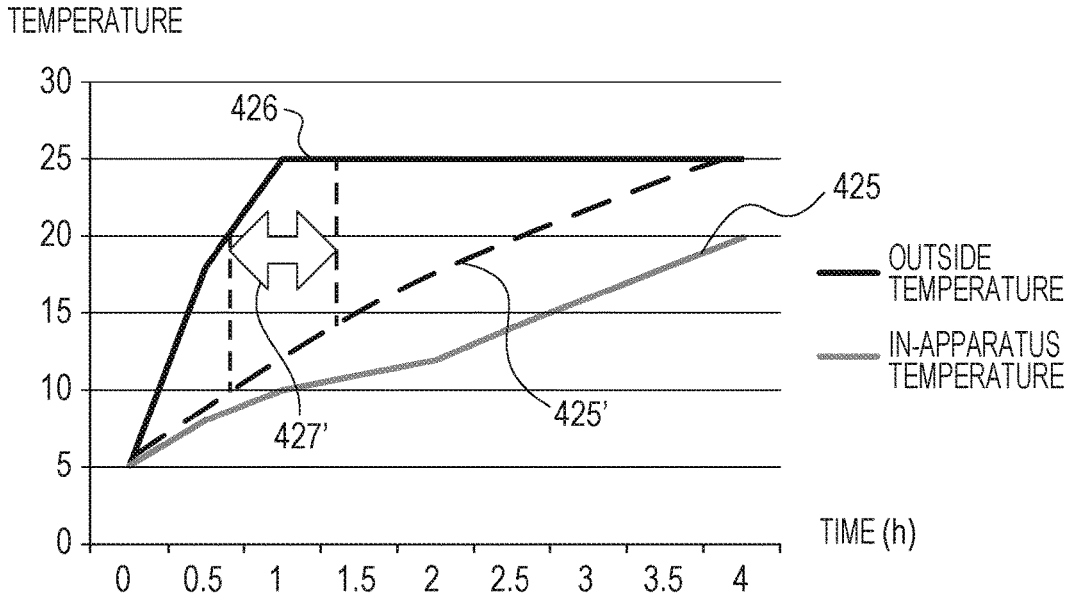
FIG. 6 is a graph illustrating the temperature difference between outside and inside of an image forming apparatus when a fan is rotated.

Referring to FIG. 6, a first dew condensation recovery operation will be described. The first dew condensation recovery operation is an operation for recovery from dew condensation by rotationally driving the fan 198 at full speed. In the present embodiment, when it is determined that dew condensation has occurred, the fan 198 is rotated even if no image forming job is submitted. Air from outside the apparatus is taken into the apparatus to eliminate the temperature difference between outside and inside of the apparatus and dry the photoconductors 124*a* to 124*d* on which dew condensation has occurred in the cartridges 120*a* to 120*d*.

The first dew condensation recovery operation accelerates the following of the in-apparatus temperature 425 to the external environment temperature 425', as illustrated in FIG. 6. Thus, the zone 427 during which dew condensation occurs can be reduced to ½ to ⅓ as in a zone 427'. In the present embodiment, the first dew condensation recovery operation has the effect of reducing the zone 417 from two hours to one hour. However, the first dew condensation recovery operation takes more time to recover from dew condensation than a second dew condensation recovery operation described below.

Second Dew Condensation Recovery Operation

Figure 7:
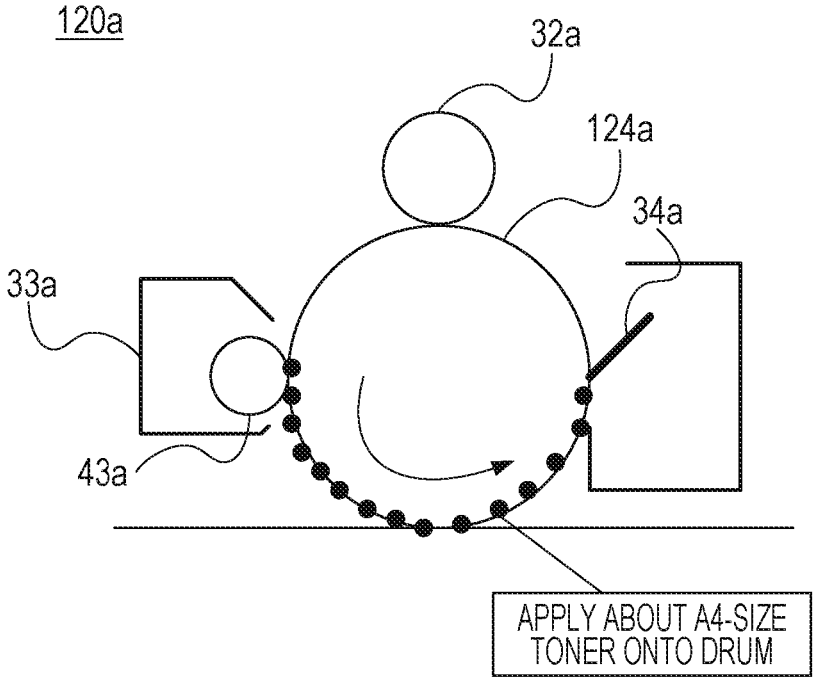
FIG. 7 is a diagram illustrating toner supply according to an embodiment of the present disclosure.

Referring to FIG. 7, a second dew condensation recovery operation will be described. The second dew condensation recovery operation is an operation of supplying a toner, or a developer, from the developing unit 33*a* to the photoconductor 124*a* and recovering the toner or the developer with the cleaner 34*a*. The second dew condensation recovery operation consumes the toner, or the developer, but has an effect of accelerating recovery of dew condensation state.

The cartridge 120*a* includes a charging roller 32*a*, a developing roller 43*a*, and the cleaner 34*a* including a cleaning blade in contact with the photoconductor 124*a*.

As illustrated in FIG. 7, toner is supplied from the developing roller 43*a* to the photoconductor 124*a*. The toner absorbs moisture on the surface of the photoconductor 124*a* and is thereafter collected by the cleaner 34*a*. This toner supply is performed for several rotations of the drum.

This dew condensation recovery operation eliminates the dew condensation on the photoconductor 124*a* at higher speed than the dew condensation recovery operation (first dew condensation recovery operation) using rotation of the fan 198. For that reason, if no image forming job is submitted, the first dew condensation recovery operation of rotating the fan 198 is executed. If an image forming job is submitted, the second dew condensation recovery operation of transferring the toner from the developing unit 33*a* to the photoconductor 124*a* is executed to eliminate the dew condensation at high speed, in addition to the first dew condensation recovery operation. Since the toner is consumed by toner supply to the photoconductor 124*a* during the second dew condensation recovery operation, it is rational to execute the second dew condensation recovery operation only when an image forming job is submitted.

When dew condensation occurs on the surface of the photoconductor 124*a*, the friction of the cleaning blade of the cleaner 34*a* can change to cause abnormal noise. The supply of toner to toe cleaning blade also has an effect of addressing the friction of the cleaning blade to eliminate the abnormal noise.

Power-Saving Control

Figure 8:
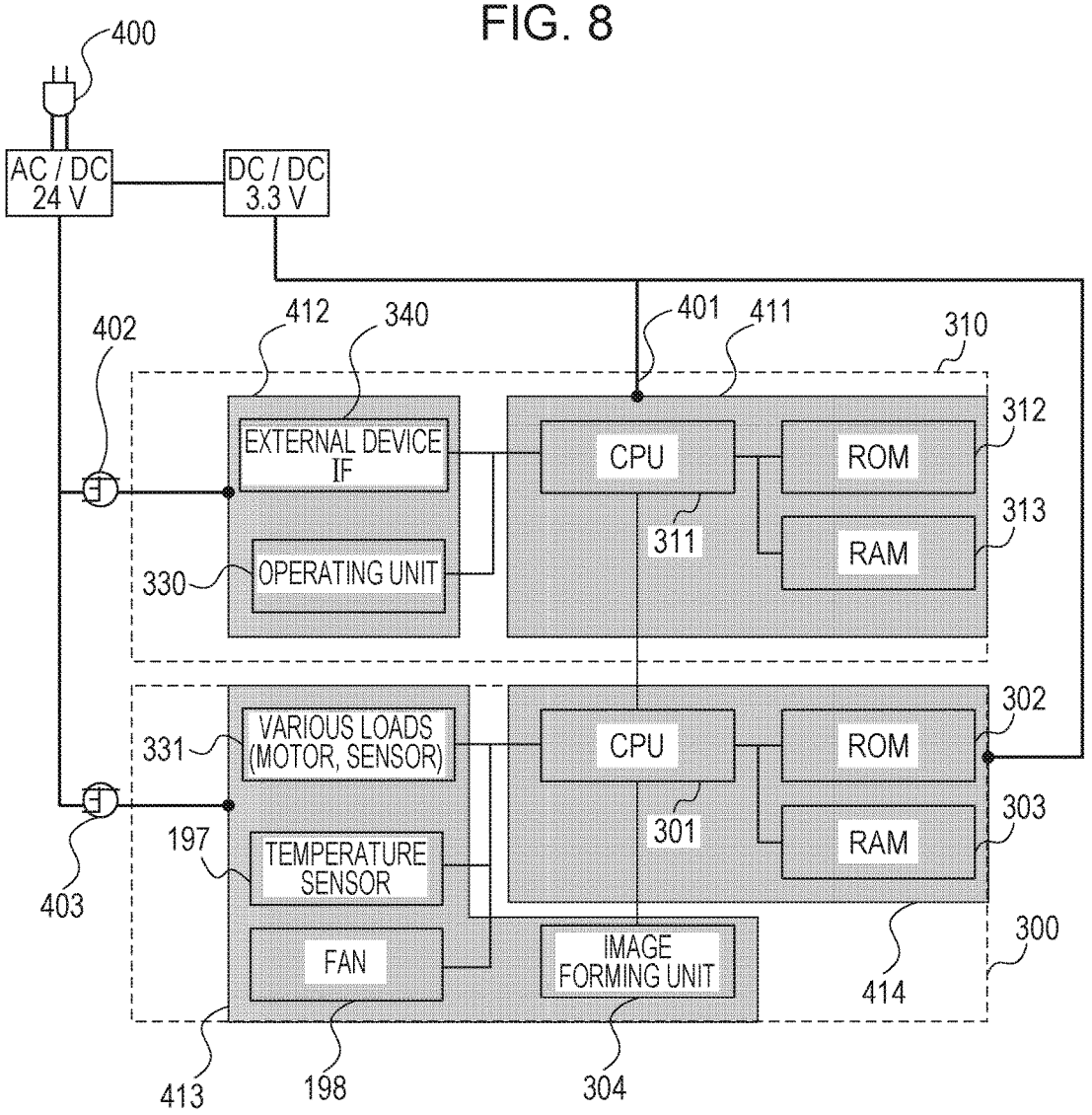
FIG. 8 is a diagram for illustrating power-saving control according to an embodiment of the present disclosure.

FIG. 8 is a diagram for illustrating power-saving control. Power supplied through an inlet 400 is supplied into four blocks, that is, a block 411 centered on the CPU 311, a block 412 including the external device IF 340 and the operating unit 330, a block 413 including various loads and the image forming unit, and a block 414 including the CPU 301. The block 411 including the CPU 311 and the block 414 including the CPU 301 are constantly supplied with power through a power line 401. The CPU 311 controls power supply to the blocks 412 and 413 by turning on and off power control switches 402 and 403, respectively.

In a state in which no image forming job is input, the CPU 311 turns off the power control switch 403 to shut down power to the block 413 into a power saving mode. In the power saving mode, power is not supplied to the fan 198, the temperature sensor (temperature detecting unit) 197, the various loads 331, such as a motor and sensors, and the CPU 301 that controls the above components.

Upon detecting a job input through the external device IF 340 or the operating unit 330 in the block 412, the CPU 311, to which power is continuously supplied also in the power saving mode, turns on the power control switch 403 to return the block 413 from the power saving mode to a standby mode.

Regular Temperature Monitoring

In the present embodiment, the CPU 301 regularly monitors the temperature sensor 197. Specifically, in the standby mode, the CPU 301 obtains an external temperature every ten minutes to monitor a short-time temperature rise. Since the temperature sensor 197 is not supplied with power in the power saving mode, the above monitoring is not performed. When the block 413 returns from the power saving mode to the standby mode, the CPU 301 obtains the value of the temperature sensor 197. Also in the power saving mode, the CPU 301 turns on the switch 403 every 70 minutes to detect the value of the temperature sensor 197 for temperature monitoring. Since the switch 403 is on in the standby mode, the CPU 301 can monitor the external temperature without controlling the switch 403.

Setting Anti-Dew-Condensation Mode

Figure 9A:
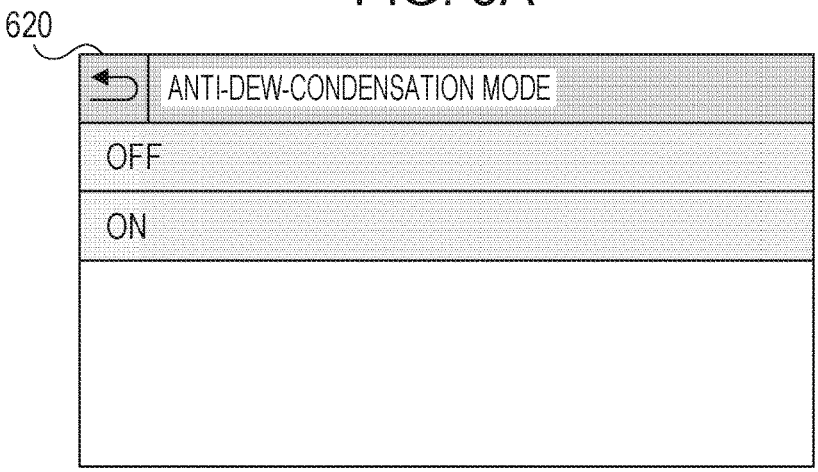
FIG. 9A is a diagram of a selection screen for enabling/disabling the anti-dew-condensation mode according to an embodiment of the present disclosure.
Figure 9B:
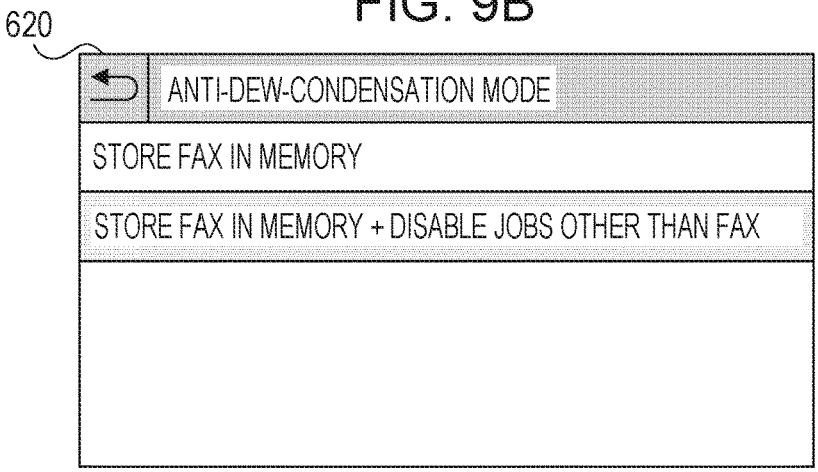
FIG. 9B is a diagram illustrating a screen that prompts the user to select one of a first mode and a second mode according to an embodiment of the present disclosure.
Figure 9C:
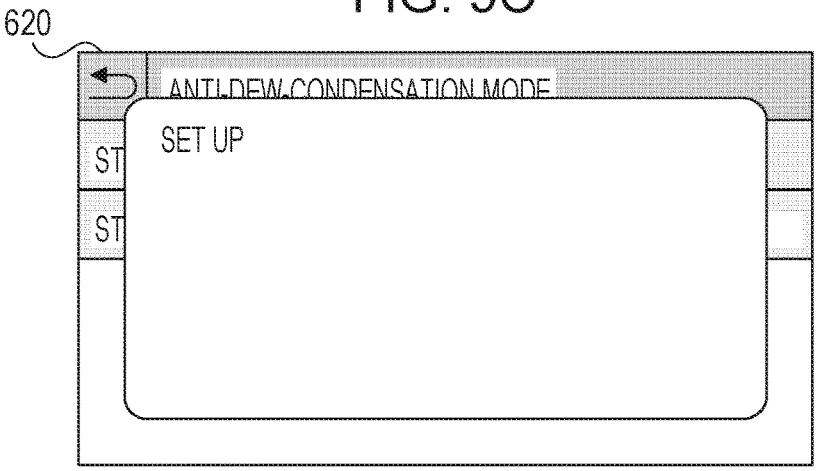
FIG. 9C is a diagram illustrating a setting completion screen according to an embodiment of the present disclosure.

The user can set an anti-dew-condensation mode by operating the operating unit 330. FIGS. 9A to 9C are diagrams illustrating the transition of a screen displayed on the operating unit 330 in the anti-dew-condensation mode. FIG. 9A is a diagram of a selection screen for enabling/disabling the anti-dew-condensation mode. When ON is selected on the selection screen in FIG. 9A, the anti-dew-condensation mode is enabled, and when OFF is selected, the anti-dew-condensation mode is disabled. When the anti-dew-condensation mode is enabled, the CPU 301 executes regular temperature monitoring and dew condensation recovery operation.

FIG. 9B is a diagram illustrating a screen that prompts the user to select one of a first mode in which a received fax is stored in a memory and a second mode in which a received fax is stored in a memory and jobs other than the fax are disabled. In the case where the first mode is selected on the screen in FIG. 9B, a received fax is stored in a memory without printing it, and when an image forming job, such as copying or printing, is received, an image forming operation is executed also during a dew condensation recovery operation. In contrast, in the case where the second mode is selected on the screen in FIG. 9B, an image forming operation is disabled regardless of the kind of job.

After mode selection in FIG. 9B, a setting completion screen illustrated in FIG. 9C is displayed on the operating unit 330.

Determining Dew Condensation Environment

Next, a process performed by the CPU 301 for determining whether dew condensation has occurred will be described. As illustrated in FIG. 4, the larger the temperature difference between the external temperature and the in-apparatus temperature and the lower the environment temperature, the more dew condensation is likely to occur. As illustrated in FIG. 5, dew condensation occurs due to the difference between the external temperature 426 and the in-apparatus temperature 425. For that reason, the difference between the external temperature and the in-apparatus temperature may be compared. However, mounting a plurality of sensors results in an increase in cost. For that reason, in the present embodiment, the in-apparatus temperature relative to the external temperature is estimated using data on the following performance of the in-apparatus temperature to the external temperature, thereby determining a dew condensation determination condition.

In the present embodiment, the condition for determining dew condensation is that a change in external temperature from 15° C. or less to 10° C. in 30 minutes is detected. With a more gradual temperature change than that, even if dew condensation occurs, it dries instantaneously. Therefore, for a more gradual temperature change, it is considered in the present embodiment that the dew condensation does not affect the image.

The CPU 301 obtains an external temperature with the temperature sensor 197 and makes a determination on the dew condensation environment on the basis of the information on the external temperature.

In the present embodiment, an example has been described in which dew condensation is determined to have occurred when a change in the external temperature from 15° C. or less to 10° C. in 30 minutes is detected. However, the present disclosure is not limited to the above example. A plurality of sensors that individually detect the ambient temperature and the in-apparatus temperature may be provided.

Description of Flowchart

Figure 10A:
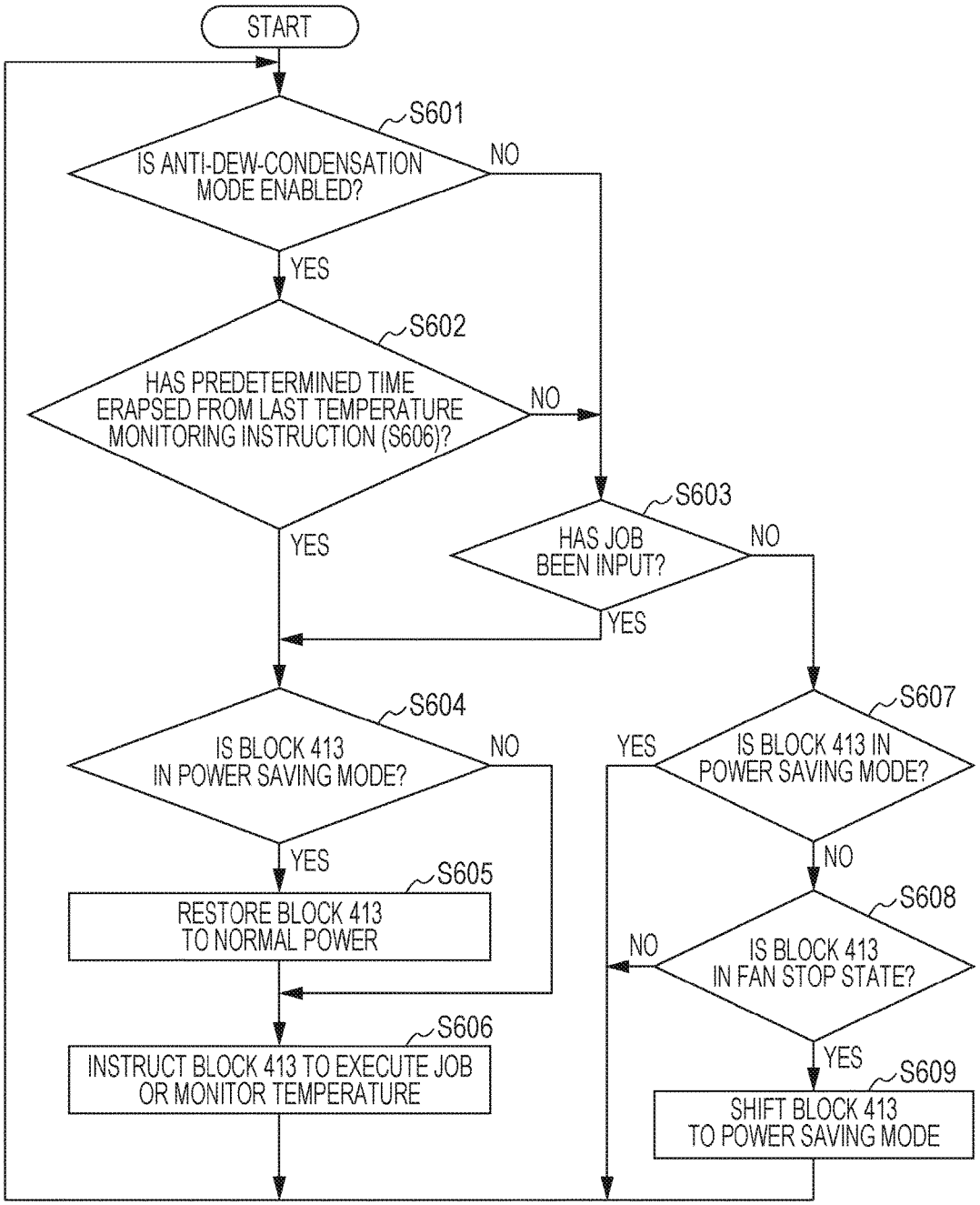
FIG. 10A is a flowchart illustrating dew condensation recovery control according to an embodiment of the present disclosure.
Figure 10B:
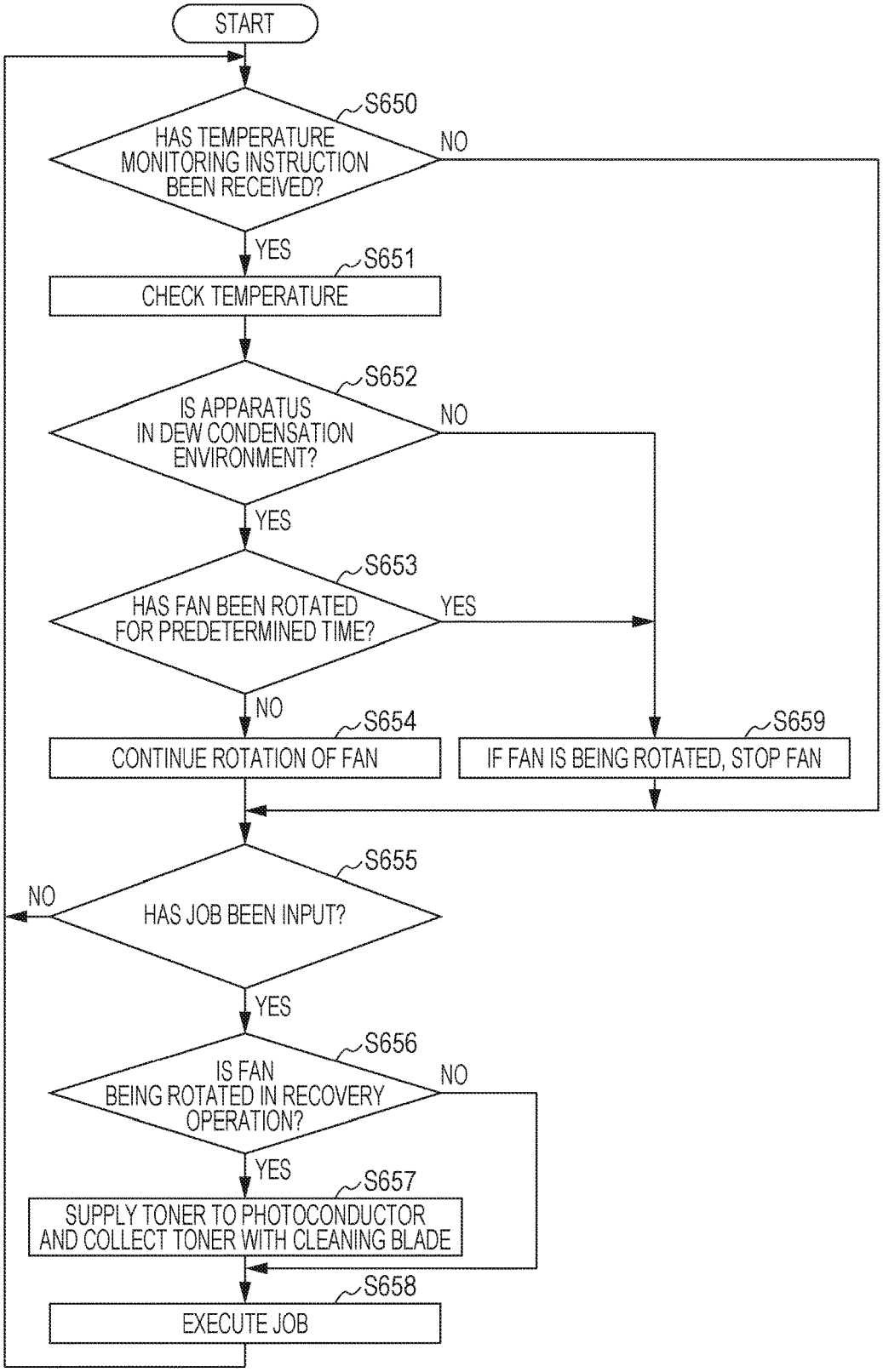
FIG. 10B is a flowchart illustrating dew condensation recovery control according to an embodiment of the present disclosure.

FIGS. 10A and 10B are respective flowcharts for the dew condensation recovery control of the CPU 311 and the CPU 301.

Referring first to FIG. 10A, the control of the CPU 311 will be described. The CPU 311 plays a role of instructing the CPU 301 of regular dew condensation monitoring and job execution.

At S601, the CPU 311 determines whether setting on the anti-dew-condensation mode is enabled or disabled on the basis of t e setting of the operating unit 330 in FIGS. 9A to 9C. If the setting on the anti-dew-condensation mode is disabled, the process goes to S603, and the CPU 311 determines whether an image forming job is input through the external device IF 340 and the operating unit 330. If no image forming job is input, then the process goes to S607, and the CPU 311 determines whether the block 413 is in the power saving mode. If the block 413 is in the power saving mode, the CPU 311 does nothing and returns to S601. In contrast, if the block 413 is not in the power saving mode, that is, in the standby mode, the CPU 311 shifts the block 413 to the power saving mode. At S608, the CPU 311 determines whether the rotation of the fan 198 is stopped. If the rotation of the fan 198 is stopped, then the CPU 311 determines that the first dew condensation recovery operation or the image forming job has ended, turns off the power control switch 403, and shifts the block 413 to the power saving mode (S609). If the fan 198 is rotating, the CPU 311 determines that the first dew condensation recovery operation is being executed and does not shift the block 413 to the power saving mode.

If at S601 the CPU 311 determines that a setting on the anti-dew-condensation mode is enabled, then at S602 the CPU 311 determines whether a predetermined time (30 minutes) has elapsed from the last temperature monitoring instruction. If the predetermined time has not elapsed, then the process goes to S603, and the CPU 311 executes the process of determining whether an image forming job has been input, as in the above. If at S603 the CPU 311 determines that an image forming job is input, then the process goes to S604, where the CPU 311 determines whether the block 413 is in the power saving mode. If it is determined that the block 413 is in the power saving mode, then at S605 the CPU 311 turns on the power control switch 403 to start energization of the various loads, the temperature sensor 197, and the fan 198 in the block 413, to return the block 413 from the power saving mode. If the block 413 has already entered the standby mode, control of the power control switch 403 is not necessary. Subsequently, at S606, the CPU 311 instructs the CPU 301 of the block 413 to execute the job or monitor the temperature.

FIG. 10B is a flowchart illustrating the operation of the CPU 301 which has received the job or the temperature monitoring instruction from the CPU 311. If at S650 the CPU 301 receives the instruction to monitor the temperature from the CPU 311, then at S651 the CPU 301 obtains the value of the temperature sensor 197. At S652, the CPU 301 determines whether the external temperature has increased from 15° C. or less to 10° C. within 30 minutes on the basis of the temperature information obtained from the temperature sensor 197. The CPU 301 determines whether the apparatus is in a dew condensation environment from the determination on the temperature.

If at S652 the CPU 301 determines that the apparatus is not in a dew condensation environment, then the process goes to S659, in which, when the fan 198 is rotating, the CPU 301 stops the fan 198. Subsequently, if at S655 the CPU 301 determines that no image forming job is input, the process returns to the process of S650 for determining whether a temperature monitoring instruction has been received.

If at S652 the CPU 301 determines that the apparatus can be in a dew condensation environment, then at S653 the CPU 301 determines whether the fan 198 has been rotated for 90 minutes. If 90 minutes has elapsed after the start of the rotation of the fan 198, the process goes to S659. If 90 minutes has not elapsed, the rotation of the fan 198 is continued (S654) to execute the first dew condensation recovery operation. At S655, the CPU 301 determines whether an image forming job has been input. If no image forming job is input, the CPU 301 continues the rotation of the fan 198 for the predetermined time (90 minutes) (S653). Upon completion of the rotation for the predetermined time (90 minutes), the rotation of the fan 198 is stopped (S659).

If at S655 the CPU 301 determines that an image forming job has been input, then at S656 the CPU 301 determines whether the fan 198 is rotating in the first dew condensation recovery operation. The fact that the fan 198 is rotating indicates that a job is input in the first dew condensation recovery operation. For that situation, at S657 the CPU 301 executes the second dew condensation recovery operation in addition to the first dew condensation recovery operation before executing the image forming job. As described above, the second dew condensation recovery operation is an operation of supplying a developer, or toner, from the developing unit 33 to the photoconductor 124 and collecting the developer, or the toner, with the cleaner 34 before execution of the image forming job. The second dew condensation recovery operation improves the dew condensation state of the surface of the photoconductor 124 to accelerate recovery of the dew condensation state. After the second dew condensation recovery operation, the CPU 301 executes the image forming job received at S655 (S658).

In the present embodiment, even after the image forming job is completed, the fan 198 continues rotating for the predetermined time of rotation. However, the fan 198 may be stopped as long as the dew condensation can be sufficiently recovered by toner supply.

The above described control can prevent toner from being consumed by a dew condensation recovery operation when no image forming job is input.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While exemplary embodiments have been described, it is to be understood that they are not limiting. The scope of the following claims is to be accorded the broadest interpretation so as to encompass all such modifications and equivalent structures and functions.

This application claims the benefit of Japanese Patent Application No. 2016-237687 filed Dec. 7, 2016, which is hereby incorporated by reference herein in its entirety.

What is claimed is:

1. An image forming apparatus comprising:

a photoconductor;

a developing unit configured to develop a latent image formed on the photoconductor, with a developer;

a transfer unit configured to transfer a developer image developed on the photoconductor onto a sheet;

a detecting unit configured to detect a temperature outside the image forming apparatus;

a rotatable fan;

a cleaning unit configured to collect toner supplied onto the photoconductor; and a controller configured to determine whether a condition for occurrence of dew condensation is satisfied based on information detected by the detecting unit, wherein, in a case where the controller determines the condition for occurrence of dew condensation is satisfied, the controller executes a first dew condensation recovery operation for rotating the fan, and when an image forming job is input, the controller executes a second dew condensation recovery operation, in addition to the first dew condensation recovery operation, the second dew condensation recovery operation comprising supplying toner from the developing unit to the photoconductor and collecting the toner with the cleaning unit, before executing the image forming job.

2. The image forming apparatus according to claim 1, wherein the controller regularly obtains a temperature outside the apparatus based on the information detected by the first detecting unit, and wherein, when a temperature increase in a predetermined time period exceeds a predetermined temperature increase threshold, the controller determines that dew condensation has occurred.

3. The image forming apparatus according to claim 1, further comprising:

an other detecting unit configured to detect a temperature inside the image forming apparatus, wherein the controller determines whether the condition for occurrence of dew condensation is satisfied based on a difference between the temperature detected by the detecting unit and the temperature detected by the other detecting unit.

4. The image forming apparatus according to claim 1, wherein, if the controller determines that the condition for occurrence of dew condensation is satisfied, the fan rotates continuously even after the image forming job is executed.

5. The image forming apparatus according to claim 1, wherein, if the controller determines that the condition for occurrence of dew condensation is satisfied, the fan rotates continuously for a predetermined time.

6. The image forming apparatus according to claim 1, wherein the controller stops the fan if the condition for occurrence of dew condensation is not satisfied.

7. The image forming apparatus according to claim 1, wherein the fan is a fan for taking air into the image forming apparatus.

8. The image forming apparatus according to claim 1, wherein the transfer unit includes an intermediate transfer belt, a primary transfer unit, and a secondary transfer unit.

9. The image forming apparatus according to claim 1, wherein the cleaning unit includes a cleaning blade in contact with the photoconductor to collect toner supplied onto the photoconductor.

10. The image forming apparatus according to claim 1, wherein the controller regularly monitors the detecting unit to obtain information detected by the detecting unit.

11. The image forming apparatus according to claim 10, wherein the controller obtains information detected by the detecting when the image forming apparatus returns from a power-saving mode to a standby mode.

* * * * *